US005522591A

United States Patent [19]

Adell

[11] Patent Number: 5,522,591

[45] Date of Patent: Jun. 4, 1996

[54] LOTTERY NUMBER PICKER KIT

[76] Inventor: Robert Adell, 31800 S. Brandingham, Franklin, Mich. 48025

[21] Appl. No.: 86,313

[22] Filed: Jul. 6, 1993

[51] Int. Cl.[6] ..... A63F 3/06

[52] U.S. Cl. ..... 273/144 B; 273/148 R

[58] Field of Search ..... 273/144 B, 148 R, 273/144 R, 138 R, 457, 145 C, 145 CA

[56] References Cited

U.S. PATENT DOCUMENTS

| | | | |
|---|---|---|---|
| 1,351,964 | 9/1920 | Orofino | 220/300 |
| 4,335,824 | 6/1982 | Bush | 215/224 |
| 4,403,775 | 9/1983 | Chaput | 273/144 B |
| 4,533,143 | 8/1985 | Albright et al. | 273/145 C |
| 4,807,881 | 2/1989 | Jaquez | 273/144 B |

FOREIGN PATENT DOCUMENTS

| | | | |
|---|---|---|---|
| 2455777 | 1/1981 | France | 273/144 B |
| 1418690 | 12/1975 | United Kingdom | 273/138 R |

*Primary Examiner*—Benjamin H. Layno
*Attorney, Agent, or Firm*—Alex Rhodes

[57] ABSTRACT

A lottery number picker which is supplied to a purchaser in disassembled form as a kit for picking numbers for daily and weekly lotteries comprising: a base having a cavity, a trap in the cavity for capturing thin cylindrical disks which are stored in the cavity; a plurality of thin cylindrical disks for loading into the cavity; and a transparent cover for viewing disks in the cavity. During an assembly of the kit by a purchaser, a selected number of disks which correspond to a purchaser's lottery are loaded into the cavity, excess disks are discarded and the cover is attached to the base. The disks are marked with numbers which correspond to the numbers from which the purchaser must choose in the purchaser's daily or weekly lottery.

10 Claims, 4 Drawing Sheets

LOTTERY NUMBER PICKER KIT

FIELD OF THE INVENTION

This invention relates to devices for randomly generating numbers and more particularly to a universal number generator which is assembled by a purchaser from a kit for picking daily and/or weekly lottery numbers.

BACKGROUND OF THE INVENTION

Government lotteries are one of the world's major businesses. Billions of dollars in revenues are generated by lotteries in various states and U.S. protectorates.

During 1991, over 21 billion dollars in revenue were derived from state lotteries. The revenue equalled the combined income of America's five most profitable corporations.

One deficiency with current lottery number pickers is that the same lottery number picker cannot be used for all of the existing daily and/or weekly lotteries.

The numbers from which selections are made for weekly lotteries in the various states range from twenty-five to fifty-four numbers. Daily lotteries require players to select three or four numbers from numbers ranging from 1 to 1000.

Another aspect of the current practice is that lottery number pickers are complex and expensive to manufacture.

In my co-pending U.S. application Ser. Nos. 08/086,308, U.S. Pat. No. 5,358,245 and application Ser. No. 08/086,029, lottery number pickers are disclosed wherein pluralities of small cylindrical disks are used for picking lottery numbers. A pair of transparent covers are permanently attached to a base by a manufacturer after the disks are loaded into the base.

Although these inventions provide numerous benefits, one disadvantage is that a manufacturer must produce seventeen different lottery pickers to meet the requirements of the various states, the only difference in the pickers being the number of disks. Another disadvantage is that a distributor must maintain a large inventory of lottery pickers.

The complexity caused by the differences in lotteries results in high investment, manufacturing and inventory costs. It can also result in poor quality because of improper assembly and/or improper shipments.

SUMMARY OF THE INVENTION

The present invention is an economical, easy to use lottery number picker which is supplied to a purchaser in disassembled form for picking daily and weekly lottery numbers. One benefit of the invention is that the same kit is used for the daily and weekly lotteries of the various states. Another benefit of the invention is reduced investment, manufacturing and inventory costs. Another benefit is that quality control problems are avoided.

The lottery number picker has a base with a pair of cavities for storing thin cylindrical disks, a plurality of thin cylindrical disks stored in each cavity and a pair of transparent covers for viewing the disks in the cavities. An excess amount of disks are supplied with the kit to accommodate all weekly lotteries. The covers and disks are supplied disassembled from the base and are attached to the base by a purchaser after a selected number of the disks are loaded into the base.

The disks are marked with numbers which correspond to the numbers from which the purchaser is required to make a selection. Lottery numbers are picked by agitating the picker to randomly orient the disks in the base and rotating the picker to capture some of the disks in traps in the base.

Several means of attaching the transparent covers are disclosed. In one embodiment, the covers threadably engage each other. In a second embodiment, a twist-lock method of attachment is used wherein a pair of inward projecting studs engage a pair of J-slots. In a third embodiment, a snap-together method is used wherein inwardly extending projections engage outwardly extending projections.

Further benefits, features and embodiments of the invention will be apparent from the ensuing description and accompanying drawings which describe the invention in detail. A preferred embodiment is disclosed in accordance with the best mode which is contemplated for practicing the invention and the specific features in which exclusive property rights are claimed are set forth in each of the numbered claims which are appended to the detailed description.

DETAILED DESCRIPTION OF THE PREFERRED EMBODIMENT

Figure 4:
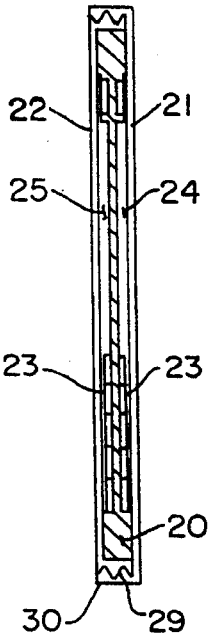
FIG. 4 is a cross-sectional view taken on the line 4—4 in FIG. 1.
Figure 1:
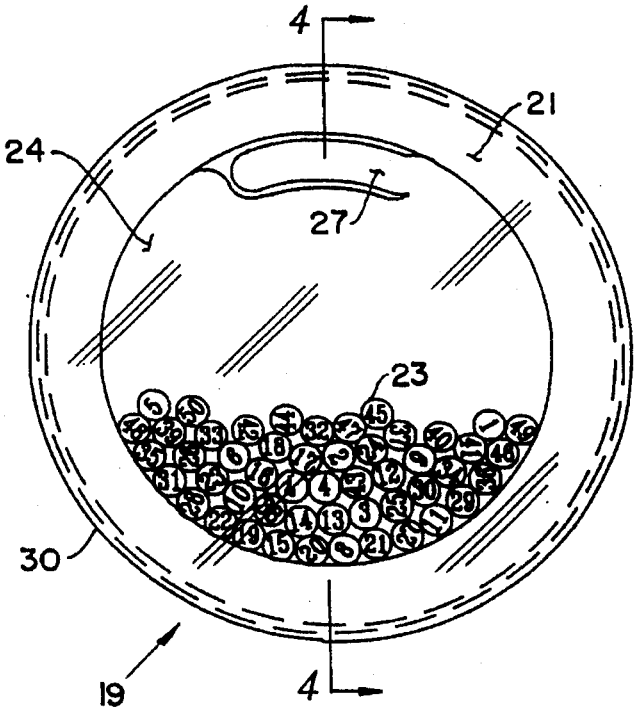
FIG. 1 is a top view of a lottery number picker according to the present invention.
Figure 2:
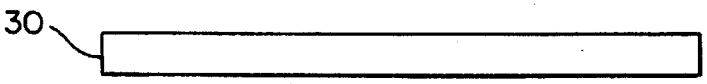
FIG. 2 is a front view of the lottery number picker.
Figure 5:
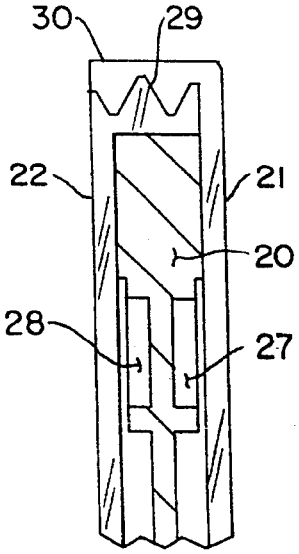
FIG. 5 is an enlarged partial view of FIG. 4 illustrating a threaded method of attachment of a pair of covers of the lottery number picker.
Figure 3:
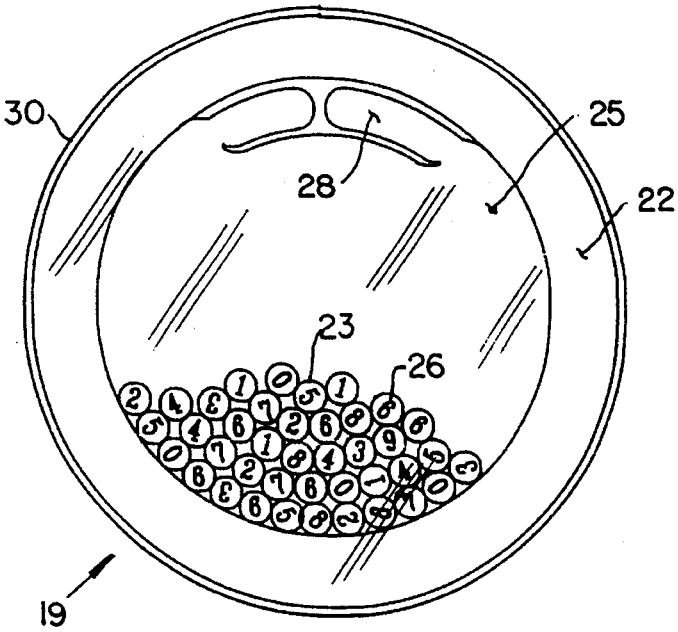
FIG. 3 is a bottom view of the lottery number picker.
Figure 8:
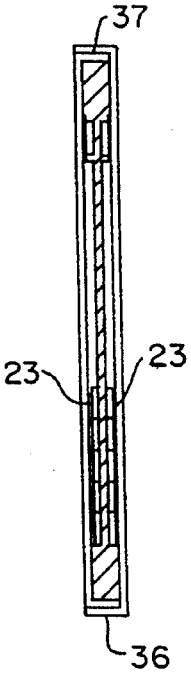
FIG. 8 is a cross-sectional view taken on the line 8—8 in FIG. 6.
Figure 7:
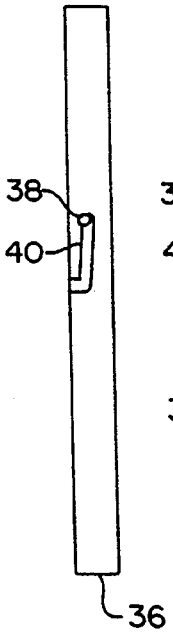
FIG. 7 is a left side view of the second embodiment.
Figure 6:
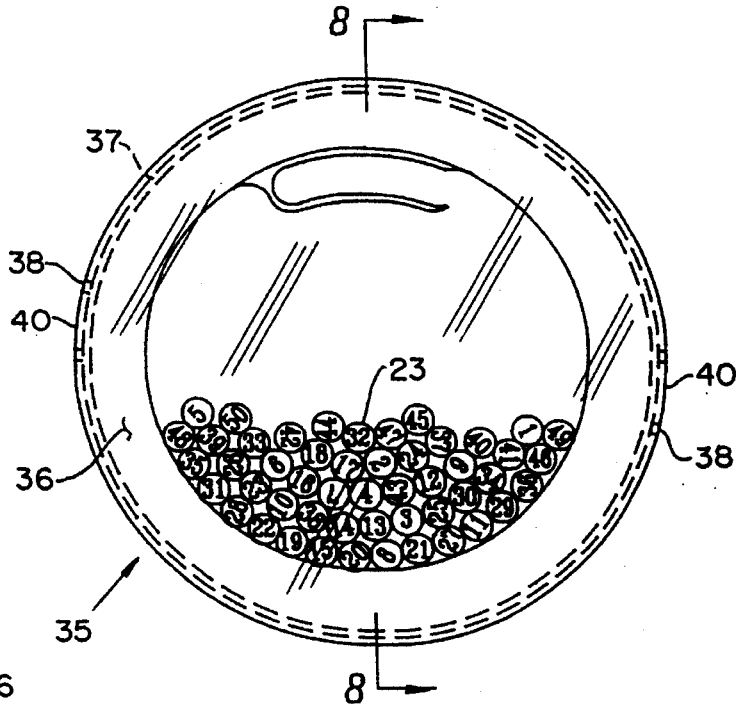
FIG. 6 is a top view of a second embodiment of the lottery number picker.

Referring now to the drawings wherein like numerals designate like and corresponding parts through the several views, a first embodiment of a lottery number picker, according to the invention, is illustrated in FIGS. 1–5, inclusive. The generally cylindrical lottery number picker, which is designated by the numeral 19, is comprised of an opaque base 20, a pair of see-through transparent covers 21, 22, and a plurality of thin cylindrical disks 23 stored in the base 20. The covers 21, 22 which are cylindrical in form are joined together by threads 29 on the side walls 30 of the covers 21, 22.

In opposite portions of the base 20 are cylindrical cavities 24, 25 wherein the disks 23 are stored. In the cavities 24, 25 are open ended traps 27, 28 for capturing disks 23 which correspond to lottery numbers. Each disk 23 has a number 25 marked on a circular face 26 of the disk 23. Preferably, numbers 25 are also marked on opposite circular faces to avoid the necessity of orienting the disks 23 in the cavities 24, 25.

The trap 27 of the base 20 is used for picking six-digit weekly numbers and the dual trap 28 in the base 20 is used for picking three and four-digit daily lottery numbers. The shape and function of the traps 27, 28 are fully described in my co-pending U.S. application Ser. Nos. 08/086,308, now U.S. Pat. No. 5,358,245 and application Ser. No. 08/086,029, which are incorporated herein by reference. One feature of the traps 27, 28 is that the disks 23 can easily enter the traps 27, 28 but are resisted from easily leaving the traps 27, 28.

The lottery number picker 19 is used as follows. The base 20, covers 21, 22 and disks 23 are supplied to a purchaser as a kit in disassembled form together with an instruction sheet which identifies the numbers of disks for the various state lotteries. The number of disks 23 which are supplied in each kit is sufficient for all of the state lotteries. The purchaser loads an appropriate number of disks 23 into the cavities 24, 25 and discards the excess disks 23. Lastly, the covers 21, 22 are assembled to the base 20 by engaging the threads 29 on the sidewalls 30 of the covers 21, 22.

By way of example, if a purchaser's weekly lottery requires the purchaser to select six numbers from a set of twenty-seven numbers, the purchaser only loads disks 1 through 27 into the cavity 24 and places the cover 21 over the cavity 24 to retain the disks 23 in the cavity 24.

For selecting three and four-digit daily lottery numbers, the purchaser inverts the base 20 and the cover 21 and loads four sets of ten disks, each set marked with the character zero and the numbers 1 through 9 into the cavity 25. The cover 22 is then threadably engaged with the cover 21 to complete the assembly.

The lottery number picker 19 is then agitated to randomly orient the disks 23 and thereafter rotated to capture some of the disks 23 in trap 27 or 28. The randomly picked number corresponds to the numbers 26 on the disks 23 which are captured in trap 27 or 28.

With reference to FIGS. 6 through 10, a second embodiment 35 is shown wherein a transparent cover 36 is joined to a transparent cover 37 using a twist-lock method of attachment. In the cover 37, at 3:00 o'clock and 9:00 o'clock positions are small outward extending studs 38 which are integral with the side wall 39 of the cover 37. In the cover 36 opposite the studs 38 is a pair of corresponding J-slots 40 which engage the small studs 38. The covers 36, 37 are joined together by engaging the studs 38 with the J-slots 40 and rotating the covers 36, 37. During the rotation the studs 38 ride up ramps 41 of the J-slots 40 and drop into recesses 42 of the J-slots 40.

In FIGS. 11 through 15, inclusive, a third embodiment 43 is illustrated wherein covers 44, 45 are joined to an octagonal base 46 by a snap-together method of attachment. One benefit of this embodiment 43 is that it allows for alternate outer shapes. The octagonal cover 44 is joined to the octagonal cover 45 by pairs of inward projections 47 at 12:00 o'clock, 3:00 o'clock, 6:00 o'clock and 9:00 o'clock positions.

Figure 10:
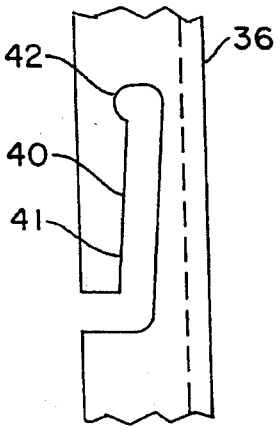
FIG. 10 is an enlarged fragmentary portion of FIG. 9.
Figure 9:
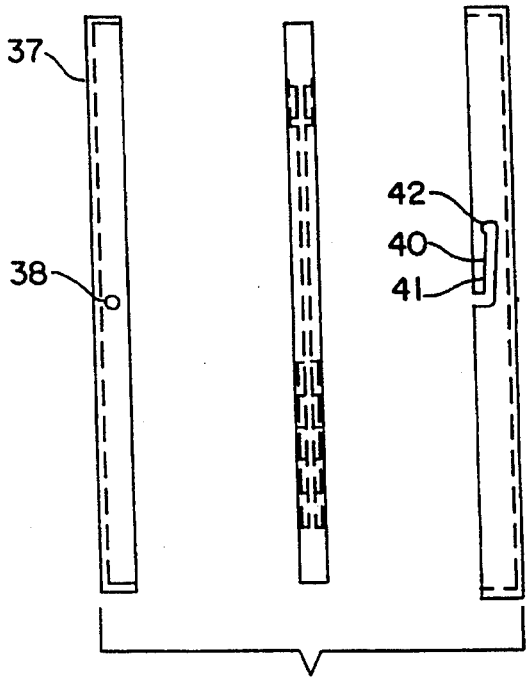
FIG. 9 is an exploded view for illustrating an alternate twist-lock method of attachment of the pair of covers.
Figure 14:
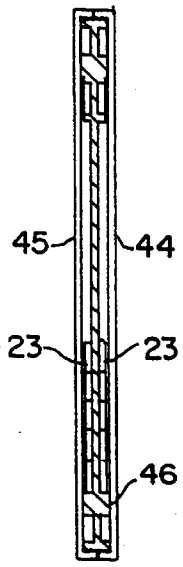
FIG. 14 is a cross-sectional view taken on the line 14—14 in FIG. 6.
Figure 11:
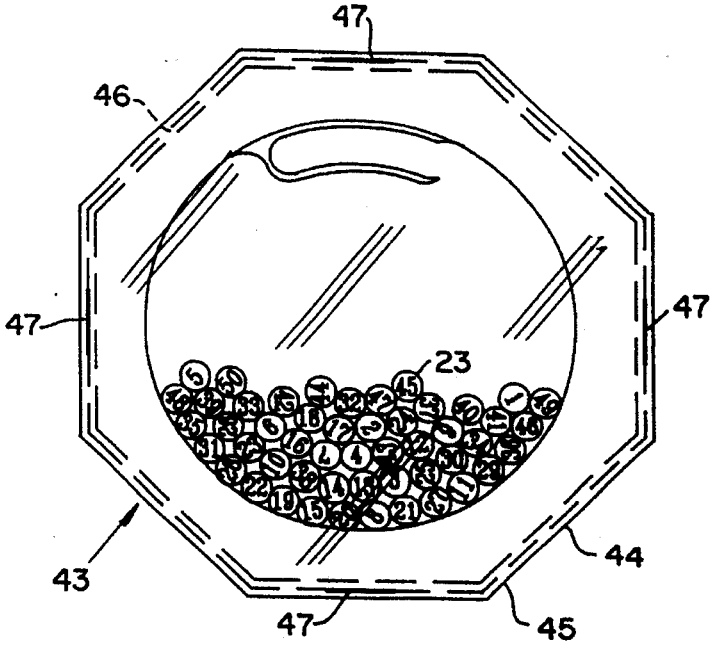
FIG. 11 is a top view of a third embodiment of the lottery number picker.
Figure 12:
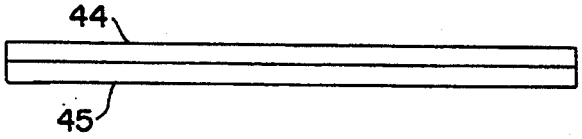
FIG. 12 is a front view of the third embodiment.
Figure 15:
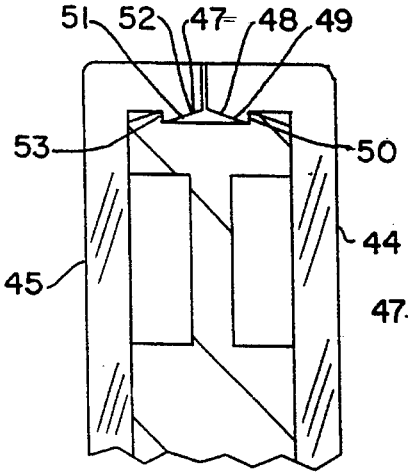
FIG. 15 is an enlarged fragmentary portion of FIG. 14 illustrating an alternate snap-together method of attachment of the pair of covers.
Figure 13:
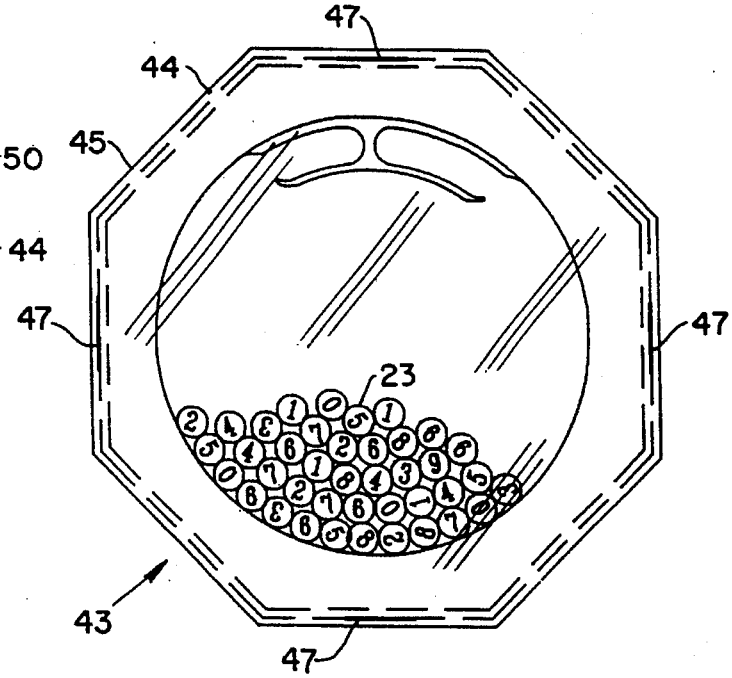
FIG. 13 a bottom view of the third embodiment.

The projections 47 which join the cover 44 to the cover 45 are best understood by reference to FIG. 10. In the octagonal side wall of the base 46 are outward extending projections 48. The outward extending base projections 48 have inclined ramp portions 49 and perpendicular locking portions 50. Opposite the base projections 48 are inward extending cover projections 51. The inward extending cover projections 51 also have inclined ramp portions 52 and perpendicular locking portions 53. The covers 44, 45 are joined to the base 46 by axially engaging the cover projections 51 and base projections 48.

Figure 16:
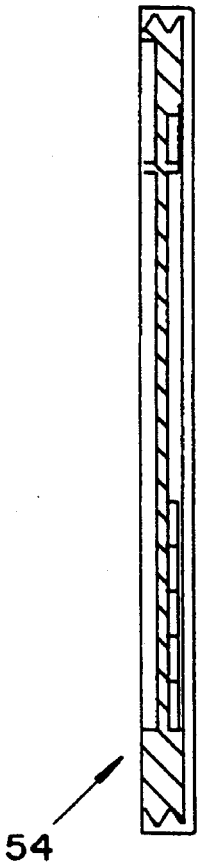
FIG. 16 is an enlarged cross-sectional view through a lottery number picker having only a single cavity wherein a transparent cover is threadably attached to a base.

In FIG. 16 is shown an alternate embodiment 54 having a single cavity for picking either a daily or weekly lottery number wherein a single transparent cover is threadably joined to a base.

Figure 17:
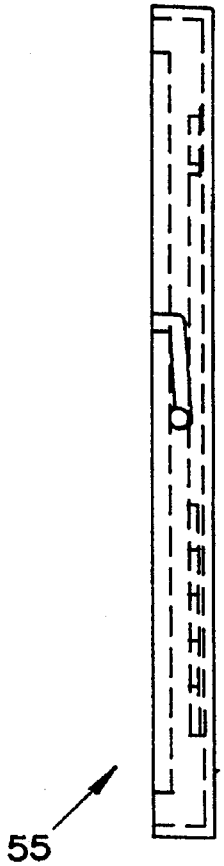
FIG. 17 is an enlarged left side view of a lottery number picker having only a single cavity wherein a transparent cover is attached to a base with the twist-lock method of attachment.

In FIG. 17 is shown an alternate embodiment 55 having a single cavity for picking either a daily or weekly lottery number wherein a single transparent cover is joined to a base by the twist-lock method.

Figure 18:
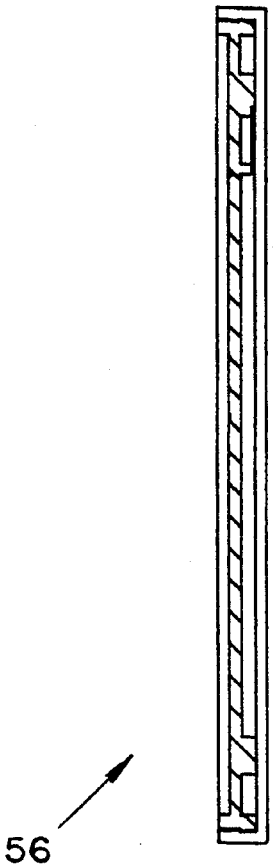
FIG. 18 is an enlarged cross-sectional view of a lottery number picker having only a single cavity wherein a transparent cover is attached to a base with the snap-together method of attachment.

In FIG. 18 is shown an alternate embodiment 56 having a single cavity for picking either a daily or weekly lottery number wherein a single transparent cover is joined to a base by the snap-together method.

From the foregoing it will be appreciated that my invention provides an improved, universal lottery number picker which can be used for weekly and daily lotteries of the various states, U.S. protectorates and foreign countries.

Although but several embodiments have been illustrated and described, it will be understood that other embodiments can be derived by changes in shape and materials as well as numbers and substitutions of parts without departing from the spirit thereof.

I claim:

1. A universal lottery picker kit for randomly picking lottery numbers in a variety of state and national lotteries comprising: a base, said base having at least one cavity having a circular outer wall and a trap for capturing at least one set of thin cylindrical disks stored in said cavity, said trap having an outer wall spaced inwardly a short distance from said cavity's outer wall, an inner wall spaced inwardly from said trap's outer wall, said inner wall having a hook-end portion for resisting a flow of captured disks out of said trap, and a ramp at said trap's open end, said ramp joining said trap's outer wall to said cavity's outer wall; a surplus quantity of thin cylindrical disks supplied with said kit, said surplus of disks comprising an arrangement of disks which enable a user of said kit during an assembly of said kit to store in said cavity a quantity of disks selected from said surplus, to randomly capture said set of disks in said trap for generating numbers for a particular state or national lottery; and a detachable cover for enclosing said cavity of said base, said cover having a means for detachably joining said cover to said base.

2. The kit recited in claim 1 wherein said cover is threadably joined to said base.

3. The kit recited in claim 1 wherein said cover has a sidewall and pair of J-slots in said sidewall and said base has a pair of small outward extending cylindrical studs for engaging said J-slots to join said cover to said base.

4. The kit recited in claim 1 wherein said cover has at least one pair of inward extending projections and said base has at least one corresponding pair of outward extending projections, said base's outward extending projections being adapted to engage said cover's inward extending projections to join said cover to said base.

5. The number picker recited in claim 4 wherein said cover and said base are octagonal.

6. The kit recited in claim 1 wherein said means for capturing disks is a means for capturing three of said disks.

7. The kit recited in claim 1 wherein said means for capturing disks is a means for capturing four of said disks.

8. The kit recited in claim 1 wherein said means for capturing disks is a means for capturing five of said disks.

9. The kit recited in claim 1 wherein said means for capturing disks is a means for capturing three or four of said disks.

10. The kit recited in claim 1 wherein said cover and said base are circular.

* * * * *